US005179247A

United States Patent [19]

Hawley

[11] Patent Number: 5,179,247

[45] Date of Patent: Jan. 12, 1993

[54] OPTICALLY INITIATED DETONATOR

[75] Inventor: John D. Hawley, East Hartland, Conn.

[73] Assignee: Ensign-Bickford Aerospace Corporation, Simsbury, Conn.

[21] Appl. No.: 730,080

[22] Filed: Jul. 15, 1991

[51] Int. Cl.[5] ..... F42C 19/08

[52] U.S. Cl. ..... 102/201

[58] Field of Search ..... 102/201, 200; 60/39.823, 256

[56] References Cited

U.S. PATENT DOCUMENTS

| | | | |
|---|---|---|---|
| 3,258,910 | 7/1966 | Seymour | 60/256 |
| 3,362,329 | 1/1968 | Epstein | 102/201 |
| 3,408,937 | 11/1968 | Lewis et al. | 102/201 |
| 3,911,822 | 10/1975 | Boling | 102/201 |
| 4,343,242 | 8/1982 | Welk | 102/201 |
| 4,892,037 | 1/1990 | Betts | 102/201 |

FOREIGN PATENT DOCUMENTS

| | | | |
|---|---|---|---|
| 1160695 | 1/1964 | Fed. Rep. of Germany | 60/256 |
| 8807170 | 9/1988 | World Int. Prop. O. | 102/201 |

*Primary Examiner*—Stephen M. Johnson
*Attorney, Agent, or Firm*—Hayes & Reinsmith

[57] ABSTRACT

Apparatus with direct initiation of a confined secondary explosive by energy delivered by a fiber optic from a laser source is achieved in a generally cup-shaped housing into which the fiber optic end extends a distance sufficient to penetrate the secondary explosive containing chamber by a significant amount. The chamber is constructed so as to provide minimum "heat sinking" or heat energy drain into the conducting materials of the chamber thereby to materially reduce the required input energy for initiation to the secondary explosive.

4 Claims, 1 Drawing Sheet

OPTICALLY INITIATED DETONATOR

This invention generally relates to laser initiation of explosives and is more particularly concerned with an improved explosive device using light energy from a low energy laser source transmitted to the explosive device by fiber optics to reliably initiate that explosive device.

BACKGROUND OF THE INVENTION

In order to more fully understand the nature of the present invention, it is necessary to understand that high explosive materials can be classified into two major groups: initiating or primary explosives, and non-initiating or secondary explosives. The present invention is specifically directed to the initiation of secondary explosives, which materials include PETN (pentaerythritotetranitrate), RDX (cyclotrimethylene trinitramine, and HMX (cyclotetramethylene tetranitramine) and any other of that explosive class which may or may not be blended with a material to improve its sensitivity to initiation by laser energy. The direct initiation of secondary explosives by laser energy transmitted through a fiber optic has heretofore required high laser energy levels to effect highly reliable initiation thereby requiring larger and more expensive laser light sources while limiting the range of application and use of such devices. PCT publication W088/07170 shows an optic detonator wherein fiber optics are used for igniting a mixture of gases such as hydrogen and chlorine; U.S. Pat. No. 4,892,037 is typical of initiation devices using primary explosives with fiber optics in physical contact with or imbedded in the consumable material so as to create a self-consumable initiator; hence U.S. Pat. No. 4,892,037 is silent as to the utilization of any teaching relating to secondary explosives. Similarly, in U.S. Pat. No. 3,408,937, the utilization of a light initiated explosive is clearly disclosed, but the inventor states that the explosive 13 is a pyrotechnic and the explosive device 11 is of no particular concern to the designer. The above listed prior art fails to disclose low energy fiber optic initiation of a secondary explosive.

A better understanding of the objects, advantages, features, properties and relations of the invention will be obtained from the following detailed description and accompanying drawings which set forth illustrative embodiments and are indicative of the various ways in which the principles of the invention are employed.

It is a primary object of this invention to permit laser initiation through fiber optics of secondary explosives with an improved structure requiring significantly lower laser energy;

It is another object of this invention to provide an economical, easily fabricated laser initiation secondary explosive containing structure that provides high reliability of initiation.

Other objects will be in part obvious and in part pointed out in more detail hereinafter.

SUMMARY OF THE INVENTION

Apparatus with direct initiation of a confined secondary explosive by energy delivered by a fiber optic from a laser source is achieved in a generally cup-shaped housing into which the fiber optic end extends a distance sufficient to penetrate the secondary explosive containing chamber by a significant amount. The chamber is constructed so as to provide minimum "heat sinking" or heat energy drain into the conducting materials of the chamber thereby to materially reduce the required input energy for initiation to the secondary explosive.

DESCRIPTION OF THE PREFERRED EMBODIMENT

Figure 1:
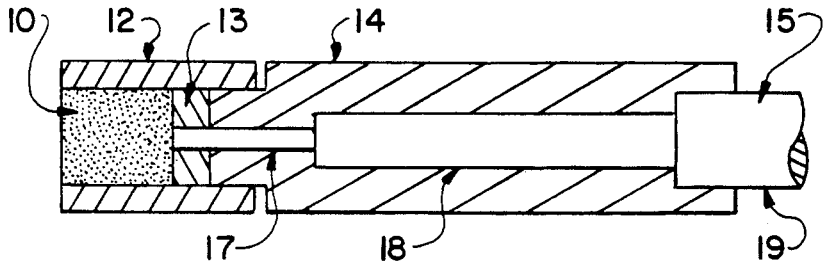
FIG. 1 PRIOR ART
FIG. 1 is a cross-section view of typical prior art initiating devices.

Turning first to FIG. 1, a cross-section view of a prior art device illustrating conventional techniques used with an initiator intended for use with a secondary explosive, the explosive charge 10 is shown as being positioned at the end of an assembly including ferrule 13, housing 14, and fiber optic element 15 which is connected to a suitable laser source (not shown). The explosive charge 10 is RDX blended with a material to enhance its sensitivity to laser light. The nature of that charge is not significant to the invention, except that it is a secondary explosive. The ferrule 13 closes an end of the charge holding chamber 12, the ferrule 13 being provided with a central aperture through which extends the fiber optic 17. For completeness, it is noted that the numeral 15 generally refers to the entire fiber optic assembly including the cladding, buffer layer 18 and reinforcing layer 19 all of which are trapped to the input housing generally designated 14 by a suitable mechanical structure so that the fiber optic is terminated flush with the chamber formed by the charge holder and the ferrule.

The device of FIG. 1 is operative and in many applications quite effective so long as sufficient energy can be delivered from the output end of the fiber optic to the secondary explosive 10 to effect reliable initiation. For purposes of completeness, it is noted that the open end of charge holder 12 is generally closed and/or connected to a further use device intended to be operated by the secondary explosive 10. Hence, the ferrule 13 and the charge holder 12 create a generally cup-shaped container which, in use, will generally become a closed cylindrical chamber when combined with the use device.

Figure 2:
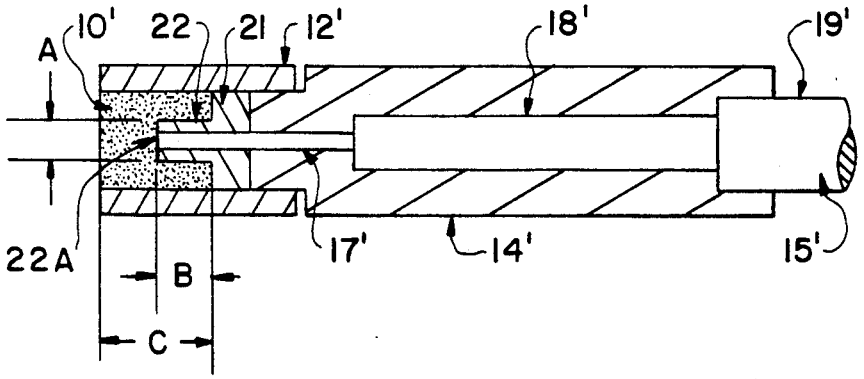
FIG. 2 is a cross-section view illustrating a principal feature of the present invention.

FIG. 2 shows one embodiment of the present invention and for purposes of clarity, a prime (') designation has been added to the numerals 10, 12, 14, 15, 18, and 19 to indicate those elements are substantially identical to the similarly numbered elements of FIG. 1.

Ferrule 21 is provided at the end face that is in engagement with the secondary explosive 10' with a generally cylindrical thin wall probe 22 extending coaxially with the fiber optic filament 17' with that filament extending at least to the end of face 22 A of the probe 22. By such an arrangement, the fiber optic 17' extends into the chamber (12', 21) containing the secondary explosive. For illustrative purposes, the dimension A has been found to be suitably provided at 0.07 inches, the dimension B to be suitably provided at 0.09 inches, the depth of the cavity being suitably provided at 0.218 inches with the probe 22 closely engaging a 400 micron diameter fiber optic element generally designated 17'. The chamber being, of course, filled with a secondary explosive 10'.

The material from which the various elements such as the charge holder, ferrule, input housing, etc. are largely a matter of choice depending on the nature of the application of the invention. It is not uncommon that such elements are formed of metallic material so that the desired small dimensions may be held with accuracy.

Figure 3:
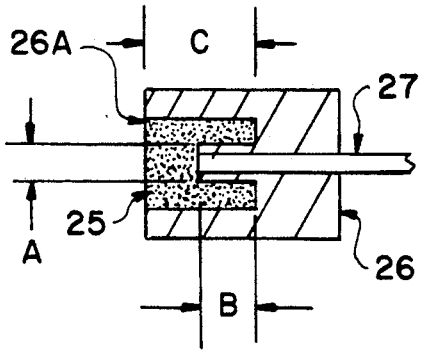
FIG. 3 is a schematic drawing showing certain essential features of the invention.

In the schematic illustration of FIG. 3, the environmental and peripheral structure shown in FIGS. 1 and 2 have been removed to permit close focus upon certain details of a preferred embodiment of this invention. It is again stressed that a typical prior art configuration even in the schematic sense of such an laser initiator, has been to terminate the fiber optic in a position flush with the bottom of the cavity (ferrule) containing the secondary explosive. Such termination has occurred for a variety of reasons depending upon the use, initiation energy available, etc.

Housing member 26 is formed from a suitable material such as steel and is provided with a cavity 26 A which is filled with secondary explosive as hereinafter described. The depth of the cavity C is approximately 0.22 inches.

An important feature of the present invention is an extension of the fiber optic member 27, typically a 400 micron fiber, into the chamber containing the explosive (shown as approximately 0.09 inches) although the amount of extension into the chamber 26*a* and the fiber diameter are, to a certain extent, a matter of choice. It has been found that initiation of a secondary explosive by an initiation device made in accordance with this invention commences at the end of the optical fiber and it has been determined to be an optimal condition where the end of the fiber terminates approximately midway through the axis of secondary explosive the chamber; tests have however, indicated that extensions between 10% and 60% of the distance into the chamber will improve the desired all-fire capability of the secondary explosive with reliability and vastly reduced energy requirements. In optimum conditions, it has been found that initiation of the secondary explosive occurs at a laser energy level of less than 0.010 joule, an energy level which is comparable to the energy level required when utilizing a sensitive or primary explosive element. Stated in other criteria, perhaps ⅓ of the energy level required when the fiber is flush with the bottom of the secondary explosive containing chamber is required to effect reliable initiation.

It is believed that a principal reason for the reduced energy requirements to effect reliable initiation of the secondary explosive is the extension of the fiber optic into the explosive containing chamber so as to avoid the very substantial "heat-sink" effect brought about by the ferrule 13 of FIG. 1 with a flush terminated fiber. Such a heat sinking effect can also occur at the opposite end of the chamber if the fiber is extended too far so as to be proximate to a closure member for the secondary explosive containing chamber, which closure member is not shown as a matter of convenience.

It is theorized that a very important reason for providing the ferrule with a thin wall metal probe extending into the chamber is that loading of the secondary explosive under pressure (perhaps as high as 25 kpsi) might otherwise distort or injure an unsupported fiber optic; however, an unsupported optical fiber will, if the secondary explosive is properly packed, be just as effective.

Achieving reliable ignition of a secondary explosive from a reduced energy laser source greatly expands the range of utility of such initiation devices, while, at the same time, reducing associated initiation costs.

As will be apparent to persons skilled in the art, various modifications, adaptations and variations of the foregoing specific disclosure can be made without departing from the teachings of this invention.

I claim:

1. Apparatus for direct initiation of a confined secondary explosive by energy delivered through a fiber optic from a laser comprising:

a generally cup-shaped housing having side walls and at least one end wall joined thereto, said housing acting as a heat conductor;

a fiber optic;

an aperture in the housing end wall for receiving the fiber optic;

said fiber optic extending into the housing a substantial distance beyond an inner surface of the housing end wall and located a substantial radial distance from the inner surface of the housing;

and a secondary explosive filling at least a portion of the interior of the cup-shaped housing said secondary explosive surrounding the protruding fiber optic to a height extending from the housing end wall to a point beyond a distal end of the fiber optic, said secondary explosive further being a powder compacted directly against the distal end of the fiber optic and in contact with the cup-shaped housing;

whereby extension of the fiber optic into the secondary explosive to a position remote from the housing minimizes an amount of heat sinking housing surface adjacent to the secondary explosive at a point of initiation and thereby reduces a level of laser energy required for reliable ignition of the secondary explosive charge.

2. The apparatus of claim 1 wherein said cup-shaped housing having side walls and at least one end wall is formed from metal with integral side and end wall and side walls of the aperture in the end wall loosely engages the distal end of the fiber optic.

3. The apparatus of claim 1 wherein a tubular fiber optic support extends from the end wall in close supporting engagement with the fiber optic and coextensive with the protruding end of the fiber optic, said fiber optic support extending into said cup-shaped housing to support the fiber optic during compaction of the secondary explosive.

4. The apparatus of claim 3 wherein the tubular fiber optic support and the end wall of the cup-shaped housing are formed integrally of metal.

* * * * *